US005653009A

United States Patent [19]

Kassardjian

[11] Patent Number: 5,653,009

[45] Date of Patent: Aug. 5, 1997

[54] JEWELRY CLASP

[76] Inventor: Haroutioun Kassardjian, 3226 Williams Blvd., Kenner, La. 70065

[21] Appl. No.: 598,801

[22] Filed: Feb. 9, 1996

Related U.S. Application Data

[63] Continuation-in-part of Ser. No. 46,068, Nov. 6, 1995 .

[51] Int. Cl.[6] ..... A44C 5/00

[52] U.S. Cl. ..... 24/667; 24/616; 24/701

[58] Field of Search ..... 24/667, 666, 662, 24/614, 683, 629, 68 J, 69 J, 70 J, 71 J, 615, 616, 701; 63/1.1, 2, 4

[56] References Cited

U.S. PATENT DOCUMENTS

| | | | |
|---|---|---|---|
| 240,032 | 4/1881 | Limbright | 24/667 |
| 718,948 | 1/1903 | Green | 24/701 |
| 1,464,452 | 8/1923 | Starck | 24/701 |
| 3,123,881 | 3/1964 | Westman | 24/701 |
| 4,532,682 | 8/1985 | Murao | 24/616 |
| 4,622,726 | 11/1986 | Nakamura | 24/616 |
| 4,958,420 | 9/1990 | Bunz | 24/653 |

FOREIGN PATENT DOCUMENTS

| | | | |
|---|---|---|---|
| 0554171 | 6/1923 | France | 24/616 |
| 0580380 | 11/1924 | France | 24/667 |
| 3017803 | 12/1980 | Germany | 24/667 |

*Primary Examiner*—Victor N. Sakran
*Attorney, Agent, or Firm*—George A. Bode; Daniel E. Maddux; Bode & Associates

[57] ABSTRACT

A clasp for connecting the ends of jewelry members is disclosed. The clasp of the present invention comprises an elongated main body member, a cooperating member for detachable connection to the main body member, and securing the cooperating member in the main body member such that the cooperating member does not dissociate from the main body member. The main body member has an aperture in one end and an elongated slot which terminates in an enlarged end on one end and connects to the aperture on the opposite end. The cooperating member has a spherical portion on one end, an eyelet portion on the opposite end, and a shank portion connecting these two portions. In the one embodiment of the present invention, securing is accomplished by a flat spring which is mounted adjacent to the slot in the main body member and extends partially over the slot to bias the cooperating member into the main body member and against the aperture. In another embodiment securing is accomplished by a helical spring being mounted in the main body member with a biasing ring that biases the cooperating member outwardly against the aperture. In another embodiment a path in the slot that is offset from the longitudinal axis of the main body member accomplishes securing. In operation, the spherical portion is inserted into the enlarged end such that the shank portion extends through the enlarged end. The shank portion of the cooperating member is then pulled through the slot and downwardly into the aperture of the main body member. Such securing prevents the cooperating means from dissociating from the main body member.

15 Claims, 6 Drawing Sheets

JEWELRY CLASP

This application is a continuation-in-part application of a previous application by the same inventor bearing U.S. Ser. No. 29/046,068 filed Nov. 6, 1995. The entire previous application Ser. No. 29/046,068 is incorporated herein by reference as if set forth in full below.

BACKGROUND OF THE INVENTION

1. Field of the Invention

The present invention relates to a clasp for jewelry, particularly a clasp for connecting together the opposing ends of jewelry, such as the chains of necklaces or bracelets, such that the jewelry ends are Secured against accidental displacement relative to each other.

2. General Background

It is known in the prior art to use a clasp to connect the ends of jewelry together. U.S. Pat. No. 1,368,665 issued to C. H. Strauss and entitled "Clasp" teaches a jewelry clasp having a hollow main body member with a slot terminating in an enlarged, basically rectangular, and which receives the basically rectangular head portion of a complemental member for detachable connection therewith. U.S. Pat. No. 1,464,452 issued to J. R. Starck and entitled "Clasp For Jewelry" teaches a similar device.

However, in normal use the jewelry ends sometimes become dissociated from the clasp and the jewelry inconveniently falls off of the wearer. Furthermore, continual use of a clasp similar to the above mentioned devices results in the slot becoming enlarged, thereby facilitating the dissociation of the jewelry ends.

Several devices have been patented which are aimed at preventing jewelry ends from dissociating from the clasp.

The Strauss '665 patent, mentioned above, relies on the rectangular shape of the enlarged end of the slot and the head portion to prevent the jewelry ends from becoming dissociated from the clasp.

The Starck '452 patent, also mentioned above, relies on tapering the slot towards the aperture, to prevent a jewelry end from becoming dissociated from the clasp.

U.S. Pat. No. 3,332,163 issued to H. P. Stewart, et al., and entitled "Fishing Tackle" discloses a fishing hook seat having a closure ring to lock the hook in the hook seat. The hook seat has a barrel with an aperture connected to an elongated slot which terminates in an enlarged end and a fishing hook which terminates in a pair of spheres separated by a link. The terminal sphere fits into the enlarged end and the rest of the hook traverses the slot to the aperture and is locked into place with the closure ring.

U.S. Pat. No. 1,419,043 issued to J. Gray and entitled "Tire Chain Fastener" discloses a tire chain fastener for connecting links of a tire chain and having a plate with a pair of grooves for receiving a bar with lugs projecting from the bar such that the lugs fit into the grooves. A pair of locking elements fit over the bar to lock the bar into place on the plate.

U.S. Pat. No. 1,692,649 issued to G. W. Goodridge, et al., and entitled "Jump Ring Coupling" discloses a ring coupling having a capsule shaped housing with a main aperture in its longitudinal side and apertures on either end of the housing to receive chain links and another aperture, which in conjunction with the main aperture, receives a key ring. Slots connect the main aperture to the end apertures. The slots taper towards the end apertures to secure chain links in the capsule housing.

U.S. Pat. No. 1,380,244 issued to C. H. Otis and entitled "Key Ring Chain" discloses a key ring chain having a coupling sleeve with a main aperture in its longitudinal side and apertures on either end of the sleeve. A tapering slot connects the main aperture to one end aperture, with the slot tapering towards the end aperture to secure the chain link in the sleeve. An enlarged slot connects the main aperture to the other end aperture. The chain link is secured in the other end aperture with a thimble mounted in the end aperture. The thimble is rotated to open or close the enlarged slot.

Other patents present in the art are U.S. Pat. No. 1,769,245 issued to W. C. Tregoning and entitled "Insulating Link For Pull Chains"; and U.S. Pat. No. 1,650,506 issued to W. J. Gagnon entitled "Coupling"; both of which are directed to connecting together the ends of chains, but do not meet the needs of the apparatus of the present invention.

The invention of the Strauss '665 patent does not teach the problem of the slot becoming enlarged due to continual use, thereby facilitating dissociation of the jewelry ends. Furthermore, the invention is unduly restrictive in requiring the enlarged end of the main member and the head portion of the complemental member to be basically rectangular shaped.

The invention of the Stewart, et al. '163 patent is directed to a fishing hook seat, not a clasp for jewelry. The invention uses a closure ring mounted on the outside of the main member to close the slot and secure the complemental member (i.e., the fishing hook). The small size of the fishing hook and hook seat makes attaching and detaching the fishing hook via the closure ring unnecessarily difficult.

The invention of the Gray '043 patent is directed to a tire chain fastener for automobiles, not a clasp for jewelry. Also, the invention does not teach the problem of the slot becoming enlarged due to continual use, thereby facilitating dissociation of the chain ends. Furthermore, the plate permits the bar to pivot in only one direction, thus limiting the movement of the bar when locked into operative engagement with the plate. In addition, attaching and detaching the bar from the plate is somewhat difficult, requiring the lugs of the bar to be fitted within grooves in the plate.

The inventions of the Goodridge, et al. '649, Otis '244 and Starck '452 patents do not teach the problem of the slot becoming enlarged due to continual use, thereby facilitating dissociation of the jewelry ends. All of these inventions employ tapering slots to prevent the complemental member from dissociating from the main member. However, tapered slots wear out and become enlarged through continual use just like untapered slots, thus failing to solve the problem of dissociation of the jewelry ends from the clasp.

The invention of the Goodridge, et al. '649 patent is furthermore limited to main members that are capsule shaped.

The invention of the Otis '244 patent also employs a thimble for closing off the slot opposite the tapering slot, similar in function to the closure ring of the Stewart, et al. '163 patent. The small size of the parts, especially the thimble, makes attaching and detaching the chain link from the clasp difficult.

The invention of the Gagnon '506 patent uses a slot that is narrower than the width of the chain link to secure the chain in the clasp. However, narrowed slots wear out and become enlarged through continual use just like unnarrowed slots, thus failing to solve the problem of dissociation of the jewelry ends from the clasp.

The invention of the Tregoning '245 patent is directed to insulating links for pull chains, not clasps for jewelry. The invention is limited to tubular members made of deformable insulating material, such as BAKELITE, which is not particularly suitable for jewelry. Also, the invention does not teach the problem of the slot in the main member becoming enlarged due to continual use, thereby facilitating dissociation of the jewelry ends.

Thus, a need exists for a jewelry clasp which overcomes the problem of the slots in prior art clasps becoming enlarged due to continual use, thereby facilitating the dissociation of the jewelry ends from the clasp.

A need also exists for a jewelry clasp in which the complemental member is easily attached to and detached from the main member.

A need also exists for a jewelry clasp which is simple in design and easy and economical to manufacture.

SUMMARY OF THE PRESENT INVENTION

The preferred embodiment of the apparatus of the present invention solves the aforementioned problems in a straightforward and simple manner. What is provided is a clasp for connecting together the ends of jewelry members, comprising an elongated main body member, a cooperating member that detachably connects to the main body member, and a means for securing the cooperating member within the main body member. The main body member has an aperture in one end and an elongated slot on a longitudinal side which connects to the aperture. The slot terminates in an enlarged end. The cooperating member includes a spherical portion on one end, an eyelet portion on the opposite end, and a shank portion connecting the spherical portion to the eyelet portion. Both the spherical portion and the outer diameter of the eyelet portion are larger than the aperture in the main body member. The spherical portion is smaller than the enlarged end of the slot in the main body member for insertion into the enlarged end. The shank portion is narrower than the slot for traversing the slot. The securing means secures the cooperating member in the main body member and prevents the cooperating member from dissociating from the main body member through the slot in the main body member. The securing means does not restrict the slot, thereby allowing for the easy attachment and detachment of the cooperating member from the main body member.

In operation, the spherical portion of the cooperating member is inserted into the enlarged end of the slot in the main body member such that the shank portion extends through the enlarged end. The shank portion of the cooperating member is then pulled longitudinally along the slot and down into the aperture in the one end of the main body member. The securing means secures the cooperating member in the main body member and prevents the cooperating member from dissociating from the main body member through the slot in the main body member.

In view of the above, it is an object of the present invention to provide a jewelry clasp which overcomes the problem of the slots in prior art clasps becoming enlarged by wear due to continual use, thereby facilitating the dissociation of the jewelry ends from the clasp.

It is a further object of the present invention to provide such a jewelry clasp in which the complemental member is easily attached to and detached from the main body member.

It is a further object of the present invention to provide such a jewelry clasp which is simple in design and easy and economical to manufacture.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 9:
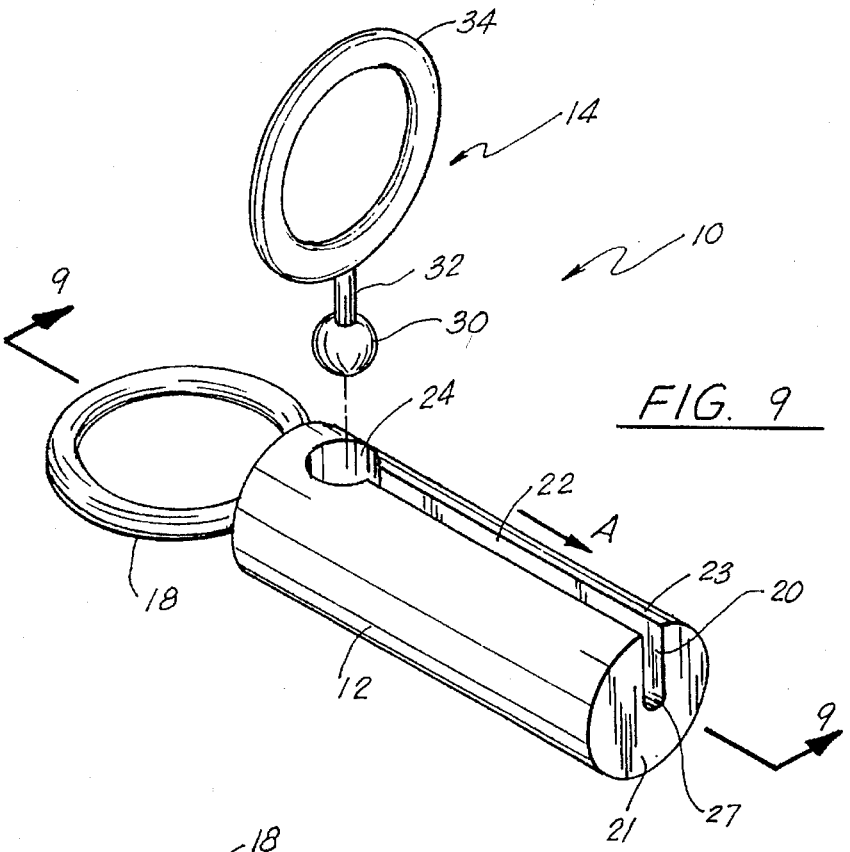
FIG. 9 is a top, front and right side perspective view of a first alternate embodiment of the apparatus of the present invention.
Figure 10:
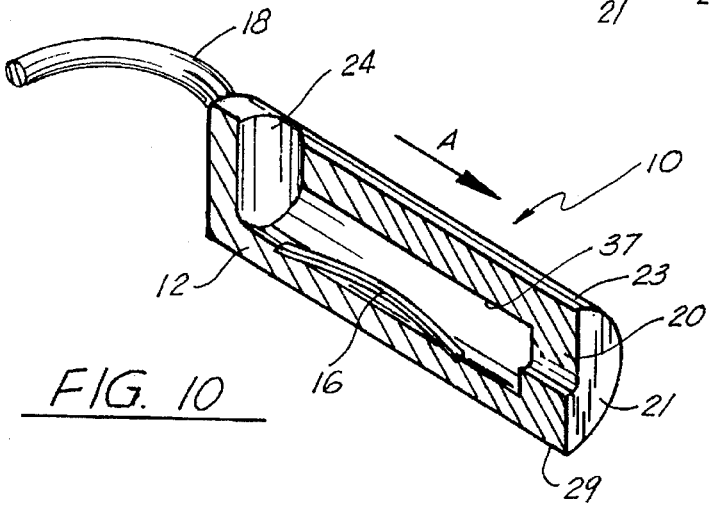
FIG. 10 is a perspective sectional view taken along the LINES 9—9 of the embodiment of FIG. 9.
Figure 11:
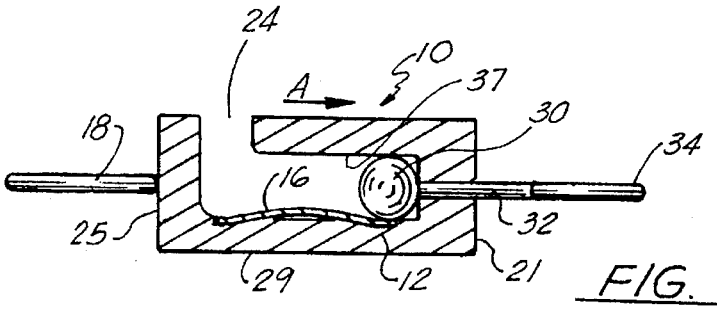
FIG. 11 is a side sectional view taken along the LINES 9—9 of FIG. 9 with the cooperating member fully inserted.

Referring now to the drawing, and in particular FIGS. 9–11, the first alternate embodiment of the apparatus of the present invention is designated generally by the numeral 10. Jewelry clasp 10 is generally comprised of elongated main body member 12, cooperating member 14, and means 16, 30, 37 for securing cooperating member 14 within main body member 12.

Main body member 12 has aperture or vertical slot 20 provided in one end 21 and elongated slot 22 provided along one longitudinal side 23 and extending therealong to the end 21 of main body member 12 to connect with aperture or vertical slot 20, as best seen in FIGS. 9 and 10. Slot 22 terminates near the end 25 opposite aperture 20 in enlarged end 24 on the same longitudinal side 23 of main body member 12, as best seen in FIGS. 9 and 11. Enlarged end 24 is larger in diameter than the diameter or width of aperture or slot 20, which is, in turn, larger than the width of slot 22. Aperture 20 is preferably a vertical slot extending in end 21 from longitudinal side 23 of main body member 12 to the center of end 21 and terminating in a semicircular portion 27; and, enlarged end 24 is preferably circular in shape, as best seen in FIGS. 9 and 11. Main body member 12 is preferably hollow, thereby forming chamber 37. Main body member 12 is preferably also tubular in shape, but is not limited to any particular size or shape. Optionally, eyelet 18 may be attached to the end 25 of main body member 12 opposite aperture 20 in end 21, as best seen in FIGS. 9 and 11. Enlarged end 24 is preferably located adjacent to end 25 of main body member 12 where eyelet 18 is attached.

Cooperating member 14 has spherical portion 30 on one end, eyelet portion 34 on the opposite end, and cylindrical shank portion 32 connecting spherical portion 30 to eyelet portion 34, as best seen in FIG. 9. Spherical portion 30 and the outer diameter of eyelet portion 34 are both larger than the diameter or width of aperture 20, as best seen in FIG. 11. Spherical portion 30 is smaller than enlarged end 24 for inserting spherical portion 30 into main body member 12 through enlarged end 24. The diameter or width and, therefore, thickness of shank portion 32 is narrower or less than that of slot 22 to allow shank portion 32 to longitudinally traverse slot 22.

Securing means 16, 30, 37 is comprised of a bowed or tensioned spring 16 mounted longitudinally inside of main body member 12 opposite slot 22, as best seen in the sectional views of FIGS. 9 and 10. Spring 16 extends longitudinally along side 29 of main body member 12, extending opposite a substantial portion of slot 22 and enlarged end 24, as best seen in FIGS. 10 and 11.

In operation, spherical portion 30 of cooperating member 14 is inserted into enlarged end 24 of slot 22 in main body member 12 such that shank portion 32 extends vertically through enlarged end 24. Shank portion 32 of cooperating member 14 is then pulled along slot 22 (in the direction of ARROW A) and to aperture or vertical slot 20. Spring 16 extends partially over the length of slot 22 and enlarged end 24, thereby biasing spherical portion 30 and, therefore, cooperating member 14 upwardly in chamber 37 of main body member 12 and eventually against aperture 20 as best seen in FIG. 11. Spring 16 thus prevents cooperating member 14 from dissociating (by moving opposite ARROW A) from main body member 12 through enlarged end 24 of slot 22. Spherical portion 30 of cooperating member 14 is larger than aperture 20 and slot 22, thus preventing cooperating member 14 from dissociating from main body member 12 through aperture 20 or slot 22. The outer diameter of eyelet .portion 34 is similarly larger than aperture 20, thereby preventing cooperating member 14 from falling into main body member 12 through aperture 20. The circular shape of chamber 37 of main body member 12 allows spherical portion 30 to pivot within main body member 12, thus allowing cooperating member 14 some freedom of movement within main body member 12. To detach cooperating member 14 from main body member 12, the force of spring 16 must be overcome as the above operation is reversed.

Figure 12:
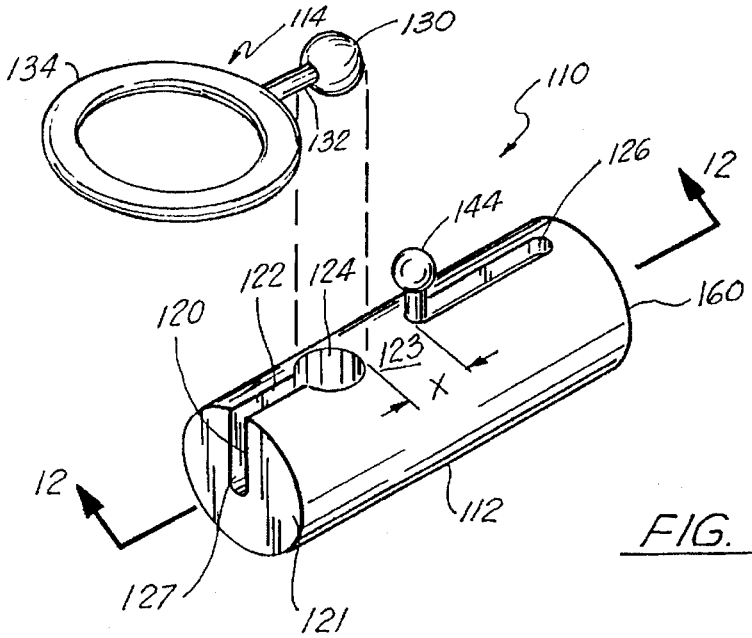
FIG. 12 is a top, rear and right side perspective view of a second alternate embodiment of the apparatus of the present invention.
Figure 13:
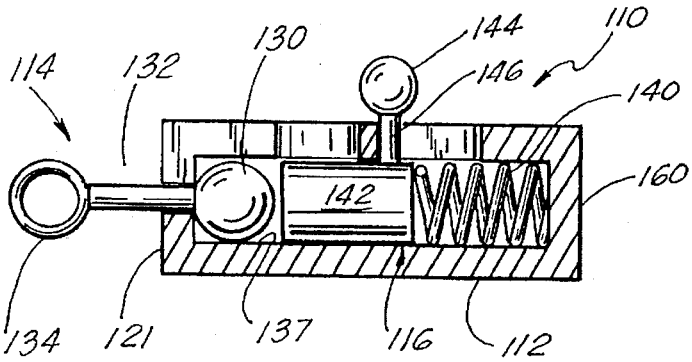
FIG. 13 is a side sectional view taken along the LINES 12—12 of the embodiment of FIG. 12 with the cooperating member fully inserted.
Figure 14:
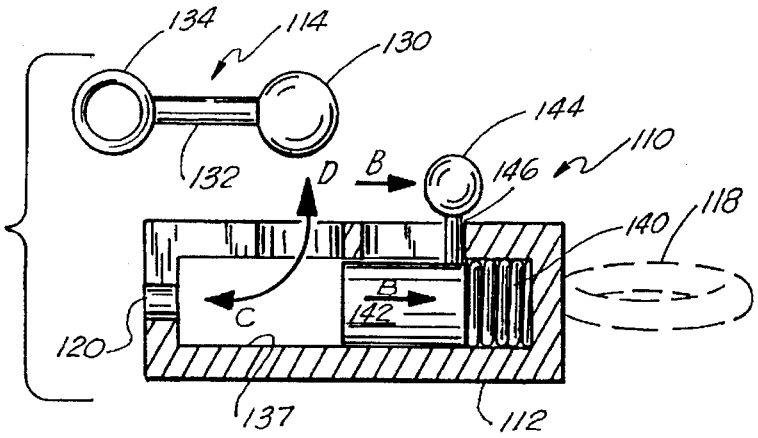
FIG. 14 is a side sectional view taken along the LINES 12—12 of the embodiment of FIG. 12 with the cooperating member removed; and, FIG. 15 is a top, rear and right side perspective view of a third alternate embodiment of the apparatus of the present invention.

Referring to FIGS. 12–14, a second alternate embodiment of the clasp of the present invention is designated by the numeral 110. Jewelry clasp 110 is generally comprised of elongated main body member 112, cooperating member 114, and means 116 (including elements 122, 130, 137, 140, 142) for securing cooperating member 114 within main body member 112.

Main body member 112 has aperture or vertical slot 120 in one end 121 and elongated slot 122 longitudinally extending partially along one longitudinal side 123 of main body member 112 to connect with aperture 120, as best seen in FIG. 12. Slot 122 terminates in main body member 112 in an enlarged aperture 124 on the longitudinal side 123 of main body member 112, also as seen in FIG. 12. The diameter of enlarged aperture 124 is larger than the diameter or width of aperture 120, which is larger than the width of slot 122. Aperture 120 is preferably vertically slotted in end 121 (as aperture 20 in end 21 of embodiment 10); and, enlarged aperture 124 is preferably circular in shape, as seen in FIG. 12. Main body member 112 further includes second longitudinal slot 126 on the same longitudinal side 123 as slot 122 and spaced therefrom by the distance "X" (FIG. 12). Second slot 126 extends from adjacent aperture 124 of main body member 112 to proximate end 160 of main body member 112. Main body member 112 is preferably hollow forming chamber 137. Main body member 112 and chamber 137 are preferably also tubular in shape, but are not limited to any particular size or shape. Optionally, an eyelet 118 may be attached to the end 160 of main body member 112 opposite aperture 120, as best seen in PHANTOM in FIG. 14.

Cooperating member 114 has spherical portion 130 on one end, eyelet portion 134 on the opposite end, and shank portion 132 connecting spherical portion 130 to eyelet portion 134, as best seen in FIG. 12. The diameter of spherical portion 130 and the outer diameter of eyelet portion 134 are both larger than the diameter or width of aperture 120. The diameter of spherical portion 130 is smaller than the diameter of enlarged aperture 124 for allowing insertion of spherical portion 130 into main body member 112 through enlarged aperture 124. The width and, therefore, thickness of shank portion 132 is narrower than the width of slot 122 to allow shank portion 132 to longitudinally traverse slot 122.

Securing means 116 includes helical spring 140 positioned in chamber 137 of main body member 112 intermediate end 160 and biasing ring 142. Biasing ring 142 is positioned between helical spring 140 and aperture 120, as seen in FIGS. 13 and 14 to urge spherical portion 130 toward aperture 120. Bead 144 is mounted on shank 146 which is connected normally to the circumference of biasing ring 142 and, therefore, extends upwardly out of second slot 126.

In operation, bead 144 is pulled towards end 160 (ARROW B), thereby moving biasing ring 142 and retracting helical spring 140 and allowing spherical portion 130 of cooperating member 114 to be reinserted in chamber 137 of main body member 112 through enlarged aperture 124. Spherical portion 130 is then inserted into enlarged aperture 124 such that shank portion 132 extends through enlarged aperture 124. Shank portion 132 of cooperating member 114 is then pulled through slot 122 and down into aperture 120 (ARROW C) to the horizontal position of FIG. 13. Bead 144 is then released, causing helical spring 140 to expand and urge biasing ring 142 against spherical portion 130, (direction opposite ARROW B), thereby biasing spherical portion 130 outwardly against aperture 120 (FIG. 13). By biasing spherical portion 130 outwardly against aperture 120, helical spring 140 and biasing ring 142 of securing means 116 prevent cooperating member 114 from dissociating from main body member 112 through slot 122. The diameter of spherical portion 130 is larger than the diameter or width of either aperture 120 or slot 122, thus preventing cooperating member 114 from dissociating from main body member 112 through aperture 120 or slot 122. The outer diameter of eyelet portion 134 is similarly larger than aperture 120, thereby preventing cooperating member 114 from falling into main body member 112 through aperture 120. The semi-circular shape of the lower end 127 of aperture 120 allows shank 132 to pivot within main body member 112, thus allowing cooperating member 114 some freedom of movement within main body member 112. To detach cooperating member 114 from main body member 112, bead 144 is again pulled towards eyelet 118 (in the direction of ARROW B) and shank portion 132 of cooperating member 114 is pulled through slot 122 to enlarged end 124. Spherical portion 130 of cooperating member 114 is then removed from enlarged end 124 of main body member 112 (ARROW D).

Referring to FIGS. 1–8, and FIGS. 1 and 7 in particular, the preferred embodiment of the clasp of the present invention is designated by the numeral 210. Jewelry clasp 210 is generally comprised of elongated main body member 212, cooperating member 214, and securing means 216 for securing cooperating member 214 within main body member 212.

Figure 1:
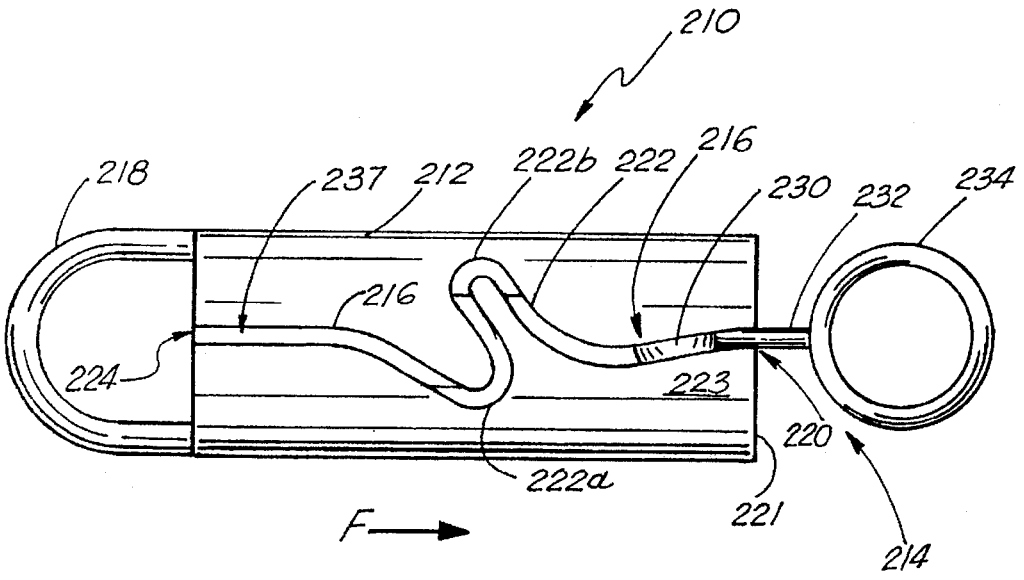
FIG. 1 is a top plan elevational view of the preferred embodiment of the present invention.
Figure 2:
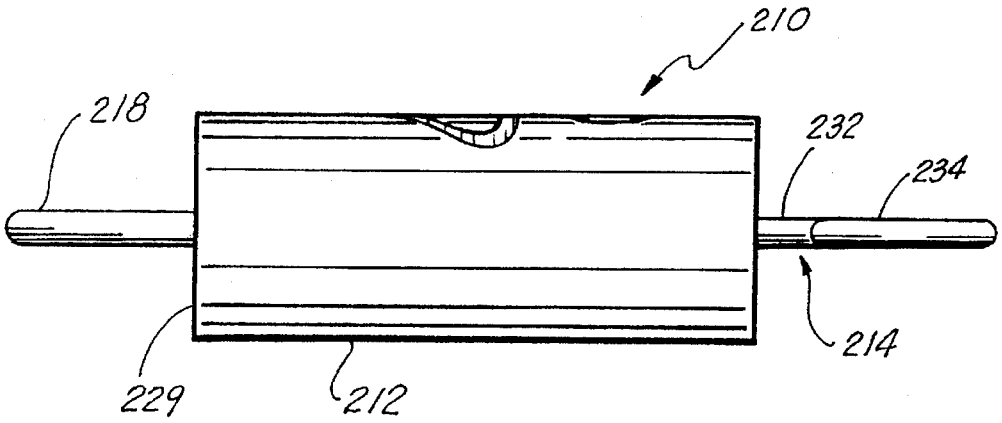
FIG. 2 is a front elevational view of the embodiment of FIG. 1.
Figure 3:
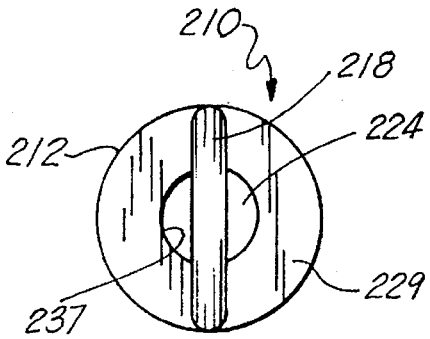
FIG. 3 is a left side elevational view of the embodiment of FIG. 1.
Figure 4:
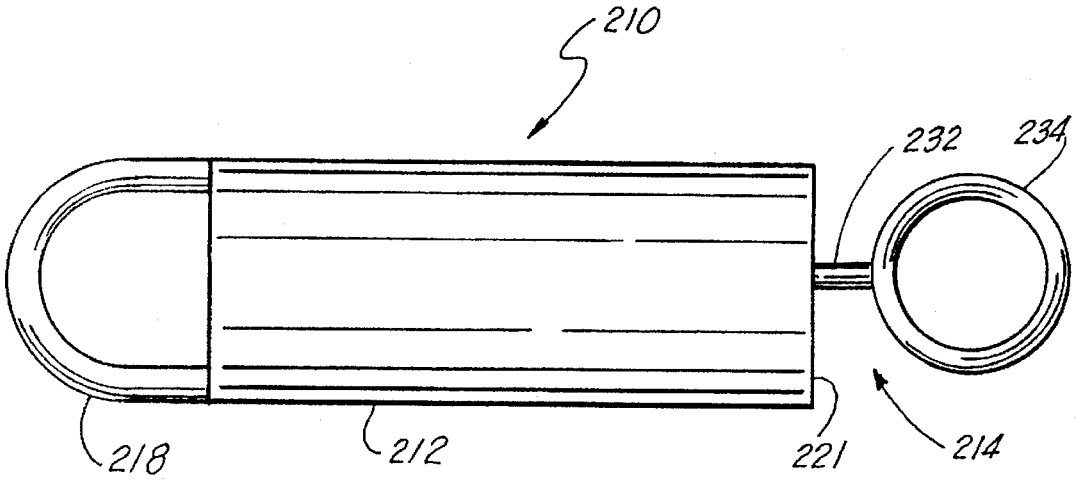
FIG. 4 is a bottom plan view of the embodiment of FIG. 1.
Figure 5:
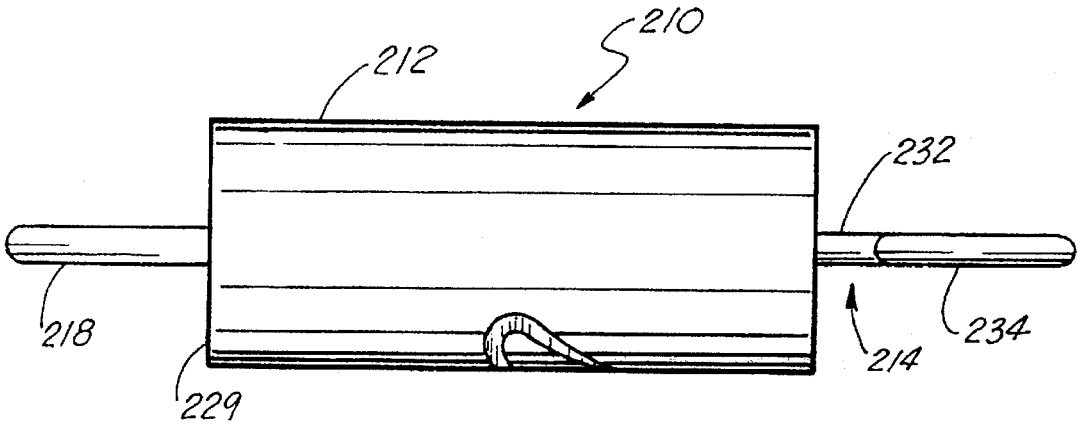
FIG. 5 is a rear elevational view of the embodiment of FIG. 1.
Figure 6:
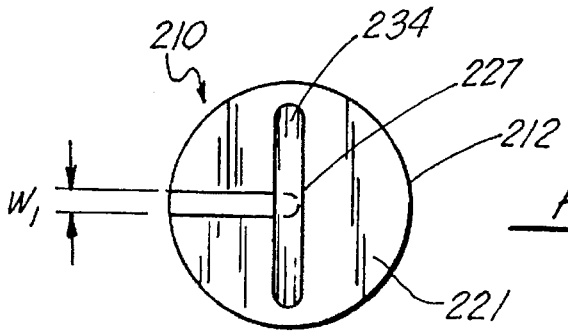
FIG. 6 is a right side elevational view of the embodiment of FIG. 1.
Figure 15:
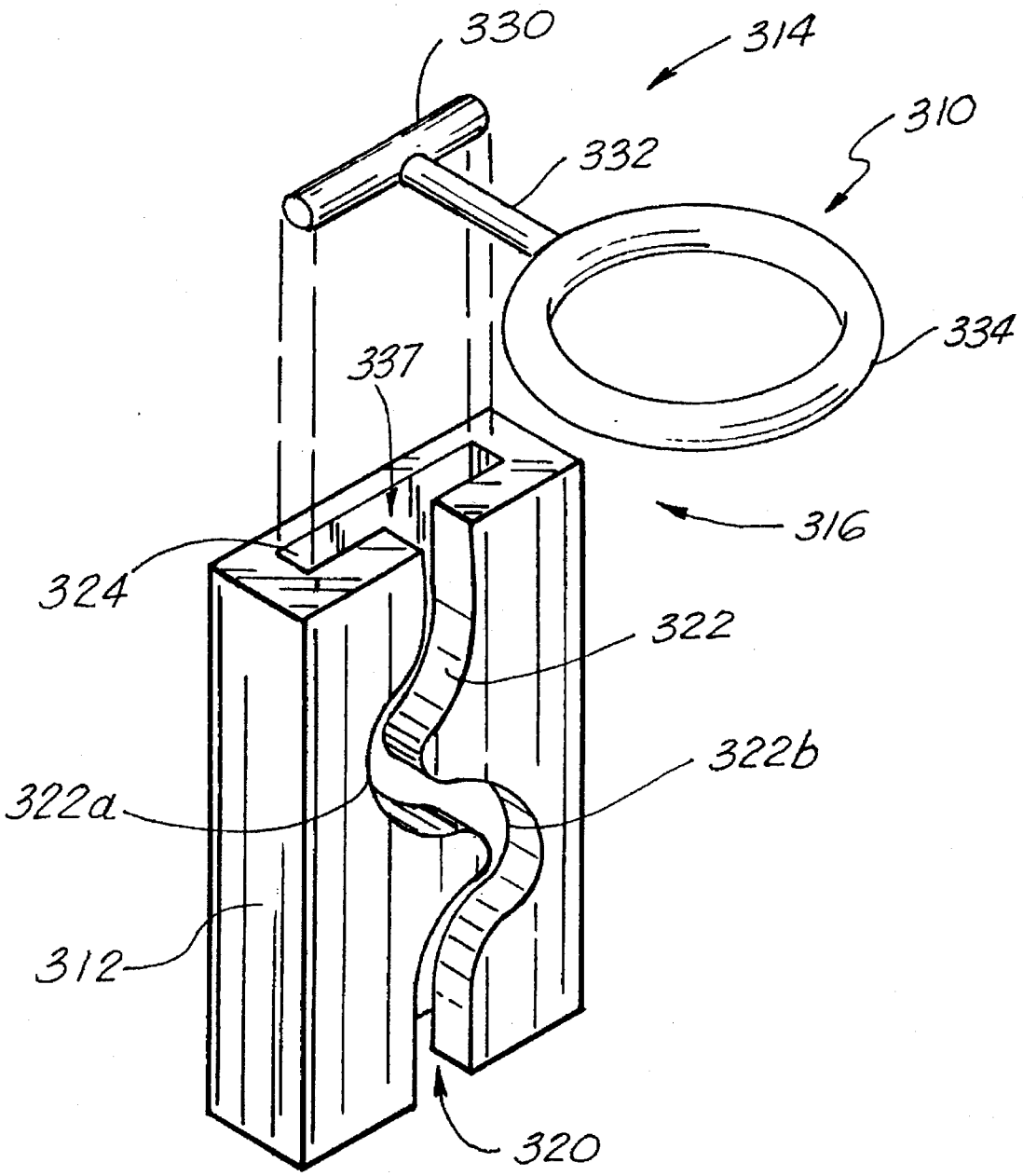

Main body member 212 is an elongated hollow cylindrical tube which forms a chamber 237 therein and has aperture or vertical slot 220 at one end 221 and connecting therewith elongated curving slot 222 on one longitudinal side 223 and which extends to the other end 229 of main body member 212 to connect with enlarged aperture 224, as best seen in FIGS. 1, 3 and 6. Slot 222 terminates in enlarged aperture 224 on the end 229 of main body member 212 opposite aperture 220, as best seen in FIGS. 1, 3 and 8. Enlarged aperture 224 is larger than aperture 220, which is larger (in diameter or width) than slot 222. Aperture 220 is preferably a vertical slot having width "$W_1$" with semi-circular lower portion 227 (in PHANTOM in FIG. 6) and enlarged aperture 224 is preferably circular in shape, as best seen in FIGS. 3, 6 and 8. Main body member 212 is preferably hollow. Main body member 212 and chamber 237 are preferably also tubular in shape (but can be rectangular in shape, as best seen in the embodiment of FIG. 15), and are not limited to any particular size or shape. Optionally, eyelet 218 (for connection to a piece of jewelry) may be attached to end 229 of main body member 212 adjacent enlarged aperture 224 such that cooperating member 214 may enter enlarged aperture 224, as best seen in FIGS. 1, 3, 4, 7 and 8.

Figure 7:
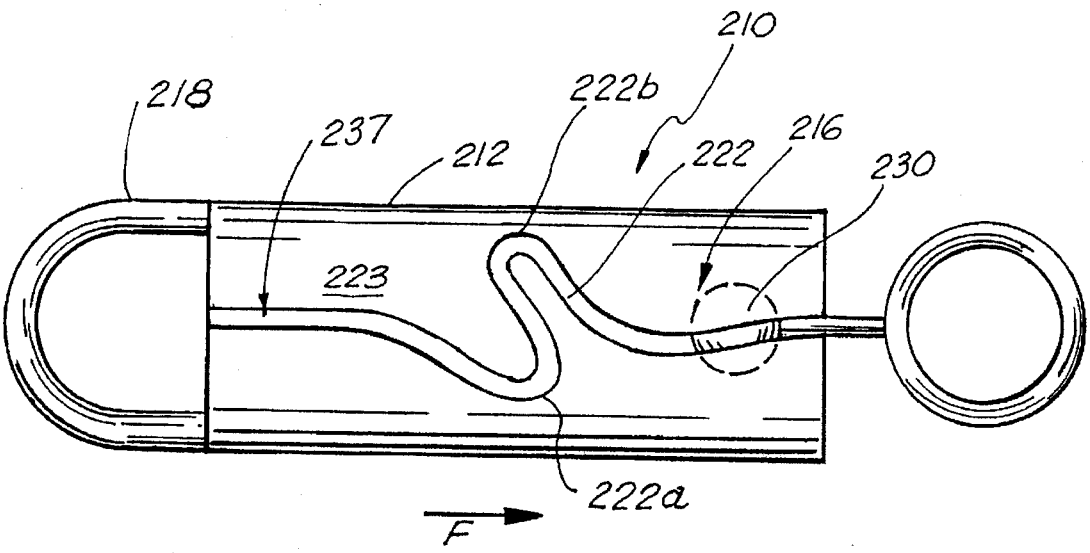
FIG. 7 is a top plan view of the embodiment of FIG. 1, illustrating, partially in PHANTOM lines, the spherical portion within the main body member at an intermediate position.
Figure 8:
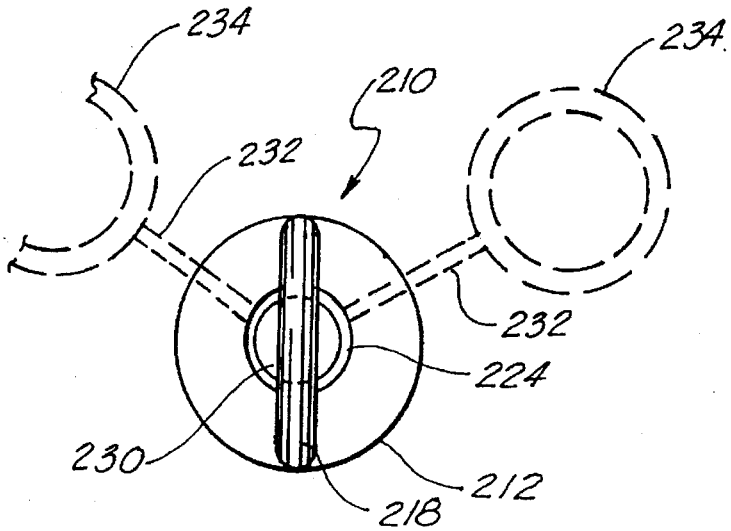
FIG. 8 is the view of FIG. 3 with the cooperating member (eyelet), shank, and spherical portions) illustrated in various intermediate positions.

Cooperating member 214 has spherical portion 230 on one end, eyelet portion 234 on the opposite end, and cylindrical shank portion 232 connecting spherical portion 230 to eyelet portion 234, as best seen in FIGS. 1, 7 and 8. The diameter of spherical portion 230 and the outer diameter of eyelet portion 234 are both larger than the width or diameter of aperture 220, as seen in FIGS. 1, 6, 7 and 8. Spherical portion 230 is smaller in diameter than enlarged aperture 224 for inserting spherical portion 230 into main body member 212 through enlarged aperture 224. The diameter or width and thickness of shank portion 232 is narrower than slot 222 to allow shank portion 232 to traverse curved slot 222.

Slot 222 follows a path offset from the longitudinal axis of main body member 212 along the longitudinal side 223 of main body member 212 to form with spherical portion 230 and chamber 237 a securing means 216, as best seen in FIGS. 1 and 7. Preferably, the offset path of slot 222 is a wavy or curved path having at least two (2) sharp curves *222a*, *222b* to prevent shank portion 232 of cooperating member 214 from traversing slot 222 and exiting enlarged aperture 224 (without human intervention).

In operation, spherical portion 230 of cooperating member 214 is inserted into enlarged aperture 224 of slot 222 in end 229 of main body member 212 such that shank portion 232 extends upwardly through slot 222 (normal to body member 212). Shank portion 232 of cooperating member 214 is then pulled along the curved path of slot 222 in the general direction of ARROW F and assumes the various intermediate positions illustrated (in PHANTOM) in FIG. 8 and then through aperture 220 to the horizontal position, as best seen in FIGS. 1 and 7. The offset path of slot 222 prevents shank portion 232 of cooperating member 214 from traversing slot 222 opposite ARROW F (without human intervention) and exiting enlarged aperture 224 of main body member 212. The offset path of slot 222 thus prevents cooperating member 214 from dissociating from main body member 212 through slot 222. The diameter of spherical portion 230 of cooperating member 214 is larger than the width/diameter of aperture 220 and slot 222, thus preventing cooperating member 214 from dissociating from main body member 212 through aperture 220 or slot 222. The outer diameter of eyelet portion 234 is similarly larger than aperture 220, thereby preventing cooperating member 214 from falling through main body member 212 via aperture 220 or enlarged aperture 224. The slotted and semi-circular shape of aperture 220 allows spherical portion 230 and shank portion 232 to pivot within main body member 212, thus allowing cooperating member 214 some freedom of movement within main body member 212. To detach cooperating member 214 from main body member 212, the above operation is reversed.

Referring to FIG. 15', an alternate embodiment 310 comprising a rectangular-shaped main body member 312 is shown. As with tubular shaped main body member 212, main body member 312 has a hollowed-out chamber 337, an aperture 320 on one end, enlarged aperture 324 on the opposite end, and slot 322 has an offset path connecting aperture 320 to enlarged aperture 324. The operation of this embodiment is similar to that of the preferred embodiment 210. Key 330 is connected to shank 332 which, in turn, is connected to and eyelet 334, key 330 enters aperture 324, and cooperating member 314 traverses slot 322; and aperture 320 is smaller than key 330 to allowing clasping by securing means 316 including key 330, slot 322 and chamber 337.

As can be seen from the drawing and above description, the various embodiments of the present invention are simple in design and easy and economical to manufacture, requiring few parts.

Furthermore, the securing means do not depend upon the width of the slot in the main body member to secure the cooperating, and main body members. Thus, the securing means of the present invention overcomes the prior art problem of the slot in a main body member becoming enlarged due to continual use and thereby facilitating dissociation of the main body member from the cooperating member.

Also, because the securing means do not restrict or close the slots in the main body members, the cooperating members are easily attached to and detached from the main body members.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A clasp for connecting the ends of jewelry members, comprising:

(a) an elongated main body member having an aperture in one end and an elongated slot on its longitudinal side, said slot connecting to said aperture at one end and terminating in an enlarged end at the opposite end, said enlarged end being positioned in an elongated longitudinal side of said main body member, said main body member further including a second slot on its longitudinal side opposite said first slot and extending from the end of said member to about a point opposite said enlarged end;

(b) a cooperating member having a first enlarged portion on one end for insertion into said enlarged end of said main member, a second enlarged portion on the opposite end for connection to the end of a piece of jewelry, and a shank portion connecting said first and second enlarged portions, the width of said shank portion being narrower than said slot to allow said shank portion to traverse said slot, said first enlarged portion and the outer diameter of said second enlarged portion being larger than said aperture; and, (c) means for securing said cooperating member within said main body member such that said securing means does not restrict said slot, said securing means comprising:

(i) a helical spring mounted in said main body member opposite the end containing said aperture and which biases said cooperating member against said aperture within said main body member;

(ii) a biasing ring positioned in said main member intermediate said helical spring add said sphere portion of said cooperating member to bias said sphere portion against said aperture; and, (iii) said biasing ring having a bead on its circumference which extends upwardly through said second slot in said main body member such that said biasing ring is retractable from engagement with said sphere portion upon pulling said bead in a direction away from said aperture, thereby allowing said cooperating member to be detached from said main body member.

2. The clasp of claim 1, wherein the end of said main body member opposite said aperture connects said main body member to the end of a piece of jewelry.

3. The clasp of claim 1, wherein said main body member provides a hollow chamber therein.

4. The clasp of claim 1, wherein said enlarged end of said slot in said main body member is substantially circular in shape.

5. The clasp of claim 1, wherein said spring is a flat spring mounted on the longitudinal side of said main body member opposite to said slot, said spring extending partially along the length of said slot and said enlarged end to bias said cooperating member downwardly into said main body member and against said aperture.

6. The clasp of claim 1, wherein:

(a) said enlarged end of said slot is located on the end of said main body member opposite said aperture; and, (b) said slot is offset from an axis running along the longitudinal side of said main body member such that said offset path of said slot forms said securing means.

7. The clasp of claim 6, wherein said offset path of said slot is a wavy path.

8. A clasp for connecting the ends of jewelry members, comprising:

(a) an elongated hollow main body member having an aperture in one end and an elongated slot on its longitudinal side, said slot connecting to said aperture at one end and terminating in an enlarged end at the opposite ends, said enlarged end being positioned in an elongated longitudinal side of said main body member, said main body member further including a second slot on its longitudinal side opposite said first slot and extending from the end of said member to about a point opposite said enlarged end;

(b) a cooperating member having a first enlarged portion on one end for insertion into said enlarged end of said main member, a second enlarged portion on the opposite end for connection to the end of a piece of jewelry, and a shank portion connecting said first and second enlarged portions, the width of said shank portion being narrower than said slot to allow said shank portion to traverse said slot, said first enlarged portion and the outer diameter of said second enlarged portion being larger than said aperture; and, (c) means for securing said cooperating member within said main body member such that said securing means does not restrict said slot, said securing means comprising:

(i) a helical spring mounted in said main body member opposite the end containing said aperture and which biases said cooperating member against said aperture within said main body member;

(ii) a biasing ring positioned in said main member intermediate said helical spring and said sphere portion of said cooperating member to bias said sphere portion against said aperture; and, (iii) said biasing ring having a bead on its circumference which extends upwardly through said second slot in said main body member such that said biasing ring is retractable from engagement with said sphere portion upon pulling said bead in a direction away from said aperture, thereby allowing said cooperating member to be detached from said main body member.

9. The clasp of claim 8, wherein the end of said main body member opposite said aperture connects said main body member to the end of a piece of jewelry.

10. The clasp of claim 8, wherein said spring is a flat spring mounted on the longitudinal side of said main body member opposite to said slot, said spring extending partially along the length of said slot and said enlarged end to bias said cooperating member downwardly into said main body member and against said aperture.

11. The clasp of claim 8, wherein:

(a) said enlarged end of said slot is located on the end of said main body member opposite said aperture; and, (b) said slot is offset from an axis running along the longitudinal side of said main body member such that said offset path of said slot forms said securing means.

12. The clasp of claim 11, wherein said offset path of said slot is a wavy path.

13. A clasp for connecting the ends of jewelry, comprising:

(a) an elongated hollow main body member having an aperture on one end, an eyelet portion on the opposite end for connecting said main member to the end of a piece of jewelry and an elongated slot on the longitudinal side of said main member, said slot connecting to said aperture on one end and terminating in an enlarged end on the opposite end, said enlarged end being positioned in an elongated longitudinal side of said main body member, said main body member further including a second slot on its longitudinal side opposite said first slot and extending from the end of said member to about a point opposite said enlarged end;

(b) a cooperating member having a sphere portion on one end for insertion into said enlarged end of said main member, an eyelet portion on the opposite end for connection to the end of a piece of jewelry, and a shank portion connecting said sphere portion to said eyelet portion, the width of said shank portion being narrower than said slot to allow said shank portion to traverse said slot;

(c) said sphere portion and the outer diameter of said eyelet portion being larger that said aperture; and, (d) means for securing said cooperating member in said main member such that said securing means does not restrict said slot, said securing means comprising:

(i) a helical spring mounted in said main body member opposite the end containing said aperture and which biases said cooperating member against said aperture within said main body member;

(ii) a biasing ring positioned in said main member intermediate said helical spring and said sphere portion of said cooperating member to bias said sphere portion outwardly against said aperture; and, (iii) said biasing ring having a bead on its circumference which extends upwardly through said second slot in said main body member such that said biasing ring is retractable from engagement with said sphere portion upon pulling said bead in a direction away from said aperture, thereby allowing said cooperating member to be detached from said main body member.

14. The clasp of claim 13, wherein:

(a) said enlarged end is located on the longitudinal side of said main member; and, (b) said securing means is a flat spring mounted on the longitudinal side of said main member adjacent to said slot and extending partially over said slot and said aperture to bias said cooperating member downwards into said main member and against said aperture.

15. The clasp of claim 13, wherein:

(a) said enlarged end of said slot is located on the end of said main member opposite said aperture; and, (b) said slot is offset from an axis running down the longitudinal side of said main member such that said offset path of said slot forms said securing means.

* * * * *